United States Patent [19]

Becher et al.

[11] 3,969,404

[45] July 13, 1976

[54] PROCESS FOR PREPARATION OF 2-METHOXY-3,6-DICHLORO-BENZOIC ACID

[75] Inventors: Heinz Manfred Becher, Bingen (Rhine); Richard Sehring, Ingelheim am Rhein, both of Germany

[73] Assignee: Celamerck GmbH & Co. KG, Ingelheim am Rhein, Germany

[22] Filed: Oct. 1, 1975

[21] Appl. No.: 618,560

Related U.S. Application Data

[63] Continuation-in-part of Ser. No. 480,685, June 19, 1974, Pat. No. 3,928,432.

[30] Foreign Application Priority Data

June 22, 1973 Germany ..... 2331712

[52] U.S. Cl. ..... 260/521 H

[51] Int. Cl.[2] ..... C07C 65/02

[58] Field of Search ..... 260/521 H, 521 B, 523 A; 204/73 R, 59

[56] References Cited

UNITED STATES PATENTS

| | | | |
|---|---|---|---|
| 3,013,058 | 12/1961 | Richter | 260/521 H |
| 3,335,177 | 8/1967 | Robin | 260/521 H |

*Primary Examiner*—Lewis Gotts
*Assistant Examiner*—D. R. Phillips
*Attorney, Agent, or Firm*—Hammond & Littell

[57] ABSTRACT

An improved method of preparing 2-methoxy-3,6-dichloro-benzoic acid which comprises the step of oxidizing 2-methoxy-3,6-dichloro-benzyl alcohol into the correspondingly substituted benzoic acid, where the improvement resides in that the said benzyl alcohol is prepared by catalytically de-brominating 2-hydroxy-5-bromo-3,6-dichloro-benzyl alcohol, followed by methylation of the 2-hydroxy substituent of the de-brominated benzyl alcohol.

4 Claims, No Drawings

PROCESS FOR PREPARATION OF 2-METHOXY-3,6-DICHLORO-BENZOIC ACID

This is a continuation-in-part of copending application Ser. No. 480,685 filed June 19, 1974 now U.S. Pat. No. 3,928,432.

This invention relates to a novel process for the preparation of 2-methoxy-3,6-dichloro-benzoic acid.

We have discovered that this compound, which is a known herbicide, can unexpectedly be prepared in an advantageous manner by de-brominating 2-hydroxy-5-bromo-3,6-dichloro-benzyl alcohol, methylating the de-brominated compound at the 2-hydroxyl-group, and oxidizing the 2-methoxy-3,6-dichloro-benzyl alcohol thus obtained.

More particularly, the present invention relates to a novel method of preparing 2-methoxy-3,6-dichloro-benzoic acid, which comprises the steps of catalytically debrominating 2-hydroxy-5-bromo-3,6-dichloro-benzyl alcohol to produce 2-hydroxy-3,6-dichloro-benzyl alcohol, methylating said 2-hydroxy-3,6-dichloro-benzyl alcohol at the 2-hydroxyl group to produce 2-methoxy-3,6-dichloro-benzyl alcohol, oxidizing said 2-methoxy-3,6-dichloro-benzyl alcohol to produce 2-methoxy-3,6-dichloro-benzoic acid, and recovering said 2-methoxy-3,6-dichloro-benzoic acid.

The novel process may be illustrated by reference to the following schematic reaction sequence:

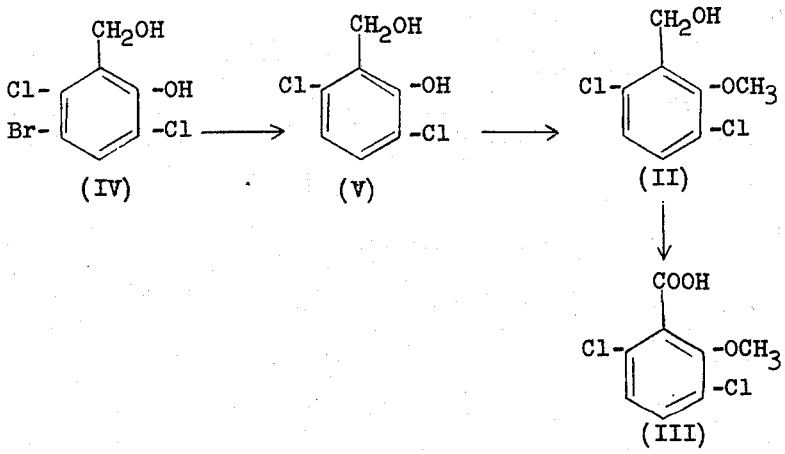

The first step of the reaction sequence consists of the catalytic debromination of 2-hydroxy-5-bromo-3,6-dichloro-benzyl alcohol with hydrogen and a suitable hydrogenation catalyst; the second step is the methylation of the phenolic hydroxyl group; and the third step consists of the oxidation of the hydroxymethyl group to the carboxylic acid group.

The process step from IV to V is conducted as a normal-pressure-hydrogenation, preferably in the presence of palladium-on-charcoal as the catalyst. It is either effected in methanol, optionally with the addition of water, or in weakly alkaline aqueous solution (pH<13). Other solvents may be used as the reaction medium as well, for example, benzene or cyclohexane; however, with the latter, products of inferior quality are generally obtained.

The methylation of V to II is carried out in accordance with known methods, for example, with dimethylsulfate.

The starting compound IV may be prepared according to U.S Pat. No. 2,631,169 by hydroxymethylation of 2,5-dichloro-4-bromophenol with excess formalin in an aqueous alkaline medium.

Oxidation of the benzyl alcohol of the formula II thus obtained to the benzoic acid of the formula III readily proceeds by means of conventional oxidation agents, for example with potassium permanganate in a heated aqueous alkaline solution. Other oxidation agents, such as nickel peroxide, can be used as well. For the production of greater quantities of the acid, the preferred method of oxidation is with oxygen in the presence of a catalyst, for example finely dispersed platinum.

The following examples illustrate the present invention and will enable others skilled in the art to understand it more completely. It should be understood, however, that the invention is not limited solely to the particular example given below.

EXAMPLE a. 2,5-Dichloro-4-bromo-phenol was hydroxymethylated in alkaline aqueous solution with excess formalin at 40°C, using a procedure analogous to that described in U.S. Pat. No. 2,631,169 to produce 2-hydroxy-3,6-dichloro-5-bromo-benzyl alcohol.

b. (1) A solution of 27.2 gm (0.10 mol) of 2-hydroxy-3,6-dichloro-5-bromo-benzyl alcohol in 300 ml of sodium hydroxide solution containing 0.10 ml of sodium hydroxide, was hydrogenated at normal pressure after the addition of 2 gm of 5% palladium/charcoal at 10° to 20°C. During the reaction 1 N sodium hydroxide solution was added dropwise so that the pH-value of the reaction mixture remained between 10 and 12. When the theoretical quantity of sodium hydroxide solution (0.10 mol of sodium hydroxide) has been added dropwise and the pH-value had dropped to 10, the hydrogenation was terminated. Subsequently, the catalyst was separated by centrifuging, the aqueous solution was brought to pH 2 to 3 with hydrochloric acid, and it was then extracted twice, each time with 150 ml of diisopropyl ether. The combined extracts were dried and evaporated. The residue became crystalline. The yield was 18.6 gm (96% of theory) of 2-hydroxy-3,6-dichloro-benzyl alcohol, m.p. 64°–67°C.

B. (2) A solution of 68 gm (0.25 mol) of 2-hydroxy-3,6-dichloro-5bromo-benzyl alcohol in a mixture of 100 ml of methanol and 25 ml of water was hydrogenated at normal pressure, after the addition of 3 gm of 5% palladium/charcoal, at 35° to 45°C. After absorption of the theoretical quantity of hydrogen, the rate of absorption decreased distinctly. At this time, hydrogenation was terminated. Then the catalyst was vacuum-filtered off and washed with water. The methanol of the filtrate was distilled off in vacuo after addition of 200 ml of water. The residue was extracted twice, each time with 200 ml of diisopropyl ether. The combined extracts were dried and evaporated. The residue became crystalline. The yield was 46.5 gm (96% of theory) of 2-hydroxy-3,6-dichloro-benzyl alcohol, m.p. 65°–68°C.

The 2-hydroxy-3,6-dichloro-benzyl alcohol prepared according to b (1) or b (2) above contained approximately 5 to 10% monochloro-2-hydroxy-benzyl alcohol.

c. Into a solution of 19.3 gm [0.10 mol of the crude product prepared according to b (1) or b (2) above] of 2-hydroxy-3,6-dichloro-benzyl alcohol in 150 ml of 1 N sodium hydroxide solution (0.15 mol of sodium hydroxide), 18.9 gm (0.15 mol) of dimethylsulfate were added dropwise at 50°–55°C, while stirring, in the course of 2 hours. Stirring was then continued for 1 hour at 55° to 60°C. Afterwards, the reaction mixture, which became weakly acid, was made alkaline by the addition of sodium hydroxide solution, cooled and extracted twice, each time with 100 ml of diisopropyl ether. The combined extracts were dried and evaporated in vacuo. The residue, oily at first, became crystalline. The yield was 15.2 gm (73% of theory) of 2-methoxy-3,6-dichloro-benzyl alcohol, m.p. 59°–61°C. The crude product was purified by recrystallization.

By acidifying the alkaline aqueous phase, 26% of the 2-hydroxy-3,6-dichloro-benzyl alcohol used could be recovered.

d. To a mixture of 10.35 gm (50 millimols) of 2-methoxy-3,6-dichloro-benzyl alcohol and 200 ml of water, adjusted to pH 8 with dilute sodium hydroxide solution, was added 1 gm of platinized asbestos, and the mixture was heated to 90°–95°C while stirring. At this temperature, oxygen was introduced into the mixture through glass frit, while stirring, whereby the pH-value decreased. When it had dropped to 6.5, it was readjusted to 10–10.5 by the addition of 0.5 N sodium hydroxide solution. Then, each time the pH-value dropped to 8 again, 0.5 N sodium hydroxide solution was added, so that the pH-value again reached to 10 to 10.5. The reaction was finished when the pH-value of the reaction mixture did not change any more. Then the reaction mixture was cooled to room temperature and the pH-value was adjusted to approximately 11. After about 1 hour, the insoluble matter, (catalyst and neutral organic substances), was vacuum-filtered off and washed with approximately 0.1 N sodium hydroxide solution. The alkaline filtrate was extracted with diisopropyl ether in order to remove neutral organic substances. The aqueous layer was strongly acidified (pH 2) with concentrated hydrochloric acid and then extracted with diisopropyl ether. The combined organic layers of this extraction were dried and evaporated. The oily residue was triturated with a small amount of benzene, whereby it became crystalline. The yield was 7.1 gm (64% of theory) of 2-methoxy-3,6-dichloro-benzoic acid, m.p. 105°–108°C. Titration with sodium hydroxide solution; equivalent = 224 (theory = 221). The results of elemental analysis corresponded to theory. The portions of the starting material which did not oxidize to the final product could be recovered and re-used for the most part.

While the present invention has been illustrated with the aid of certain specific embodiments thereof, it will be readily apparent to others skilled in the art that the invention is not limited to these particular embodiments, and that various changes and modifications may be made without departing from the spirit of the invention or the scope of the appended claims.

We claim:

1. A process for the preparation of 2-methoxy-3,6-dichloro-benzoic acid comprising the steps of catalytically debrominating 2-hydroxy-5-bromo-3,6-dichloro-benzyl alcohol to produce 2-hydroxy-3,6-dichloro-benzyl alcohol, methylating said 2-hydroxy-3,6 -dichloro-benzyl alcohol at the 2-hydroxy group to produce 2-methoxy-3,6-dichloro-benzyl alcohol, oxidizing said 2-methoxy-3,6-dichloro-benzyl alcohol to produce 2-methoxy-3,6-dichloro-benzoic acid, and recovering said 2-methoxy-3,6-dichloro-benzoic acid.

2. The process of claim 1, in which said debromination is effected by hydrogenation at normal pressure in the presence of a palladium catalyst.

3. The process of claim 1, in which said debromination is effected in a reaction medium comprising a mixture of methanol and water.

4. The process of claim 1, in which said oxidation is effected with oxygen in the presence of a catalyst.

* * * * *